US010265965B2

(12) United States Patent
Ogawa

(10) Patent No.: US 10,265,965 B2
(45) Date of Patent: Apr. 23, 2019

(54) IMAGE RECORDING APPARATUS AND CARTRIDGE

(71) Applicant: Brother Kogyo Kabushiki Kaisha, Nagoya-shi, Aichi-ken (JP)

(72) Inventor: Mikio Ogawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/939,399

(22) Filed: Mar. 29, 2018

(65) Prior Publication Data

US 2018/0281441 A1 Oct. 4, 2018

(30) Foreign Application Priority Data

Mar. 31, 2017 (JP) ..... 2017-073054

(51) Int. Cl.
*B41J 2/175* (2006.01)
*B41J 2/195* (2006.01)
*B41J 29/38* (2006.01)

(52) U.S. Cl.
CPC ..... *B41J 2/17566* (2013.01); *B41J 2/1752* (2013.01); *B41J 2/17509* (2013.01); *B41J 2/17513* (2013.01); *B41J 2/17523* (2013.01); *B41J 2/17546* (2013.01); *B41J 2/17553* (2013.01); *B41J 2/195* (2013.01); *B41J 29/38* (2013.01); *B41J 2002/17573* (2013.01); *B41J 2002/17576* (2013.01)

(58) Field of Classification Search
CPC ..... B41J 2/17566; B41J 2/17509; B41J 2/17513; B41J 2/1752; B41J 2/17523; B41J 2/17546; B41J 2/17553; B41J 2/195; B41J 29/38; B41J 2002/17573; B41J 2002/17576
USPC ..... 347/87
See application file for complete search history.

(56) References Cited

U.S. PATENT DOCUMENTS

2001/0055041 A1 12/2001 Yonekubo
2002/0118244 A1 8/2002 Yonekubo
2004/0257410 A1* 12/2004 Yamada ..... B41J 2/175 347/84

(Continued)

FOREIGN PATENT DOCUMENTS

JP H09-277560 A 10/1997
JP 2001-353885 A 12/2001

*Primary Examiner* — Huan Tran
*Assistant Examiner* — Alexander D Shenderov
(74) *Attorney, Agent, or Firm* — Banner & Witcoff, Ltd.

(57) ABSTRACT

An image recording apparatus, including: a holder on which a cartridge including a liquid chamber storing a liquid is mountable; a liquid-passage defining portion defining a liquid passage including a first end and a second end connected to the head, the first end configured to be connected to the liquid chamber when the cartridge is mounted on the holder; and a controller, wherein the controller is configured to divide a region in the liquid chamber occupied by the liquid into a plurality of regions in an up-down direction and determine a viscosity of the liquid in each region, based on a time elapsed from a timing of connection of the liquid chamber and the first end of the liquid passage, and wherein, when the liquid is discharged from the head, the controller updates the viscosity in each region, based on an amount of the liquid discharged from the head.

20 Claims, 8 Drawing Sheets

(56) References Cited

U.S. PATENT DOCUMENTS

| | | | | |
|---|---|---|---|---|
| 2012/0007903 | A1* | 1/2012 | Igarashi | B41J 2/16508 347/9 |
| 2012/0013658 | A1* | 1/2012 | Otis | B41J 2/17513 347/6 |
| 2016/0279956 | A1* | 9/2016 | Nukui | B41J 2/17523 |

* cited by examiner

FIG.8A

VISCOSITY REFERENCE TABLE

| No. | FROM BOTTOM (%) | VISCOSITY CHANGE |
|---|---|---|
| 1 | 0～5 | ＋3 |
| 2 | 5～20 | ＋1 |
| 3 | 20～80 | ±0 |
| 4 | 80～95 | −0.5 |
| 5 | 95～100 | −1 |

FIG.8B

MIXTURE RATIO TABLE (PV100)

| | | REGIONS BEFORE RE-DIVISION (%) | | | | |
|---|---|---|---|---|---|---|
| | | 1 | 2 | 3 | 4 | 5 |
| REGIONS AFTER RE-DIVISION | 1 | 0 | 98 | 2 | 0 | 0 |
| | 2 | 0 | 65 | 35 | 0 | 0 |
| | 3 | 0 | 0 | 95 | 5 | 0 |
| | 4 | 0 | 0 | 5 | 90 | 5 |
| | 5 | 0 | 0 | 0 | 30 | 70 |

MIXTURE RATIO TABLE (PV500)

| | | REGIONS BEFORE RE-DIVISION (%) | | | | |
|---|---|---|---|---|---|---|
| | | 1 | 2 | 3 | 4 | 5 |
| REGIONS AFTER RE-DIVISION | 1 | 0 | 20 | 80 | 0 | 0 |
| | 2 | 0 | 20 | 80 | 0 | 0 |
| | 3 | 0 | 2 | 60 | 38 | 0 |
| | 4 | 0 | 0 | 5 | 85 | 10 |
| | 5 | 0 | 0 | 0 | 30 | 70 |

IMAGE RECORDING APPARATUS AND CARTRIDGE

CROSS REFERENCE TO RELATED APPLICATION

The present application claims priority from Japanese Patent Application No. 2017-073054, which was filed on Mar. 31, 2017, the disclosure of which is herein incorporated by reference in its entirety.

BACKGROUND

Technical Field

The following disclosure relates to an image recording apparatus configured to discharge a liquid stored in a cartridge from a head and also relates to the cartridge.

Description of Related Art

There is known an image recording apparatus on which an ink cartridge storing ink is removably mountable. The ink cartridge includes a memory in which is stored information about a date of manufacture of the ink cartridge. The image recording apparatus obtains a change in density of the ink in an up-down direction of the cartridge after a lapse of a predetermined time, based on density of the ink immediately after the manufacture stored in the memory, and discharges, by purging, the ink existing in a lower portion of the cartridge or does not use the ink existing in an upper portion of the cartridge.

SUMMARY

The change in the viscosity of the ink due to sedimentation of a pigment contained in the ink occurs not only in a period from a time point immediately after manufacture of the cartridge to a time point when the cartridge starts to be used, but also in a period after the cartridge starts to be used. Further, when the cartridge starts to be used, namely, immediately before the cartridge is mounted on the apparatus for the first time, a user may be prompted by a notice on the cartridge to shake the cartridge for agitating the ink stored in the cartridge. Thus, even if the change in the viscosity of the ink is obtained only based on the time elapsed after manufacture, it is not possible to deal with the change in the viscosity of the ink that occurs after the cartridge starts to be used.

Accordingly, one aspect of the present disclosure relates to a technique of accurately estimating a viscosity of a liquid stored in a liquid chamber of a cartridge after the cartridge starts to be used.

On aspect of the present disclosure relates to an image recording apparatus, including: a holder on which a cartridge is to be mounted, the cartridge including a liquid chamber storing a liquid; a head configured to discharge the liquid; a liquid-passage defining portion defining a liquid passage, the liquid passage including a first end and a second end connected to the head, the first end configured to be connected to the liquid chamber of the cartridge when the cartridge is mounted on the holder; and a controller, wherein the controller is configured to: divide a region in the liquid chamber of the cartridge occupied by the liquid into a plurality of regions in an up-down direction; and determine a viscosity of the liquid in each of the plurality of regions, based on a time elapsed from a timing of connection of the liquid chamber of the cartridge and the first end of the liquid passage, and wherein, when the liquid in the liquid chamber is discharged from the head, the controller updates the viscosity of the liquid in each of the plurality of regions, based on an amount of the liquid discharged from the head.

On aspect of the present disclosure relates to an image recording apparatus, including: a holder on which a cartridge is to be mounted, the cartridge including a liquid chamber storing a liquid; a head configured to discharge the liquid; a liquid-passage defining portion defining a liquid passage, the liquid passage including a first end and a second end connected to the head, the first end configured to be connected to the liquid chamber of the cartridge when the cartridge is mounted on the holder; and a controller, wherein the controller is configured to divide a region in the liquid chamber of the cartridge occupied by the liquid into a plurality of regions in an up-down direction and determine a viscosity of the liquid in each of the plurality of regions, based on a time elapsed from a timing of connection of the liquid chamber of the cartridge and the first end of the liquid passage.

Another aspect of the present disclosure relates to a cartridge to be mounted on an image recording apparatus, the cartridge including a liquid chamber storing a liquid, wherein the image recording apparatus includes a holder on which the cartridge is to be mounted, a contact, and a controller, wherein the cartridge includes a cartridge memory electrically conductive with the contact connected to the controller, in a state in which the cartridge is mounted on the holder, and wherein the cartridge memory stores a viscosity of the liquid in each of a plurality of regions provided by dividing, in an up-down direction, a region in the liquid chamber occupied by the liquid.

BRIEF DESCRIPTION OF THE DRAWINGS

The objects, features, advantages, and technical and industrial significance of the present disclosure will be better understood by reading the following detailed description of an embodiment, when considered in connection with the accompanying drawings, in which:

FIG. 8A shows a viscosity reference table and FIG. 8B shows mixture ratio tables.

DETAILED DESCRIPTION OF THE EMBODIMENT

Figure 1:
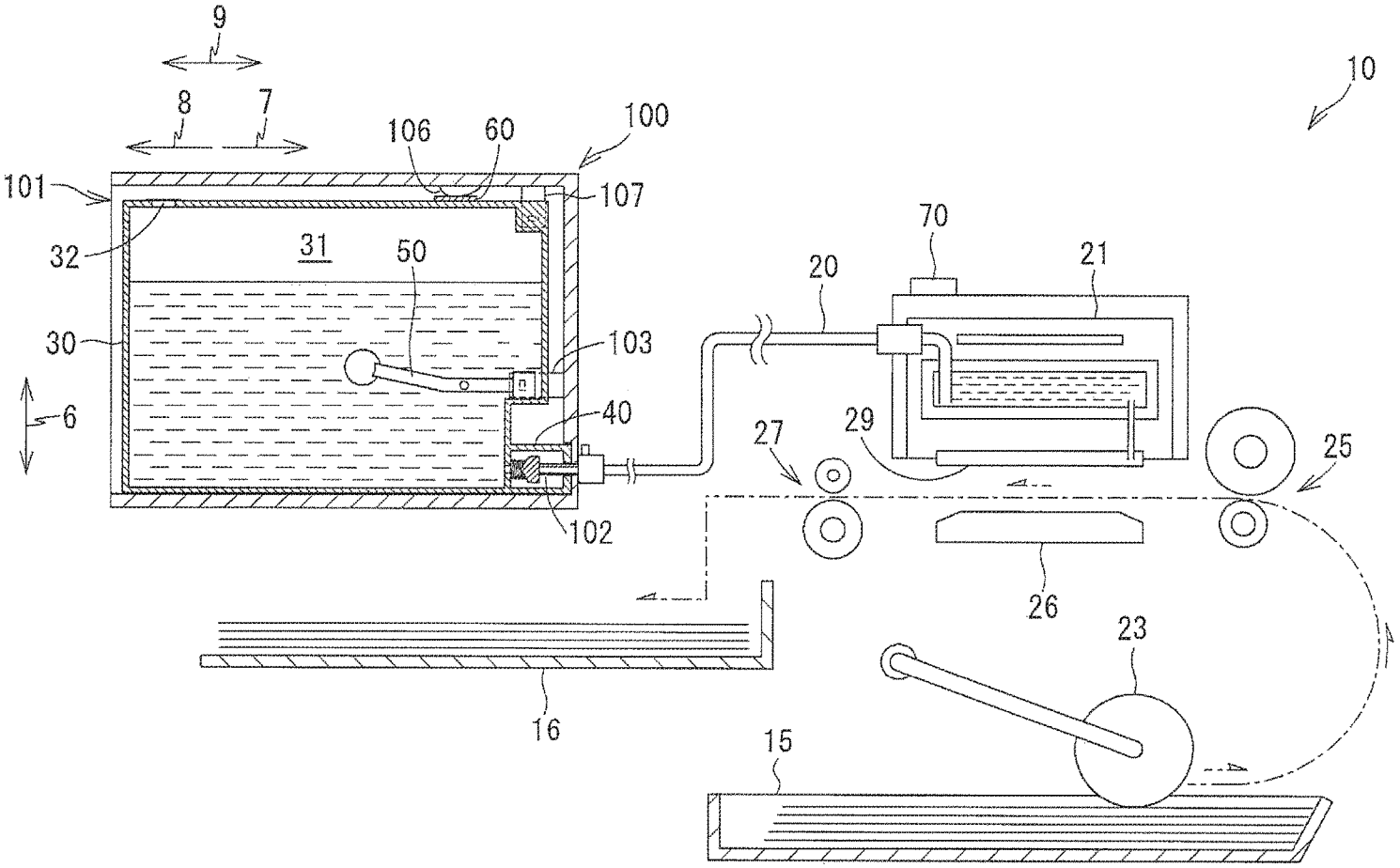
FIG. 1 is a cross-sectional view schematically showing an internal structure of a printer including a cartridge holder according to one embodiment.

Referring to the drawings, there will be explained one embodiment of the present disclosure. It is to be understood that the following embodiment is described only by way of example, and the present disclosure may be otherwise embodied with various modifications without departing from the scope of the present disclosure.

Outline of Printer 10

A printer 10 according to one embodiment is one example of an ink-jet image recording apparatus configured to record an image on a sheet. As shown in FIG. 1, the printer 10 includes a sheet-supply tray 15, a supply roller 23, conveying rollers 25, a head 21 including a plurality of nozzles 29, a platen 26 facing the head 21, discharge rollers 27, a sheet-discharge tray 16, a cartridge holder 100 on which a cartridge 30 is removably mountable, a tube 20 fluidically connecting the head 21 and the cartridge 30 mounted on the cartridge holder 100, and a temperature sensor 70 disposed near the head 21.

The printer 10 drives the supply roller 23 and the conveying rollers 25 such that the sheet supported on the sheet-supply tray 15 is conveyed onto the platen 26. The printer 10 then ejects, from the nozzles 29, ink supplied from the cartridge 30 mounted on the cartridge holder 100 through the tube 20 by applying a predetermined drive voltage to the head 21. The application of the drive voltage to the head 21 causes the piezoelectric elements to be vibrated, so that the ink is ejected from the nozzles 29. Thus, the ink is attached to the sheet supported on the platen 26, and an image is formed on the sheet. The printer 10 then drives the discharge rollers 27 so as to discharge, to the sheet-discharge tray 16, the sheet on which the image is formed. A connected portion of the tube 20 and the head 21 is one example of a second end of a liquid passage.

Cartridge Holder 100

The cartridge holder 100 is shaped like a box having an inner space for accommodating the cartridges 30. The inner space of the cartridge holder 100 is defined by a top wall, a bottom wall, an end wall, and a pair of side walls. The cartridge holder 100 has an opening 101 formed at a position opposing to the end wall, and the inner space of the cartridge holder 100 is exposed to an exterior through the opening 101. The cartridge 30 is inserted into and removed from the inner space of the cartridge holder 100 through the opening 101.

In the following explanation, a direction in which the cartridge 30 is inserted into the cartridge holder 100 will be referred to as "insertion direction 7", and a direction in which the cartridge 30 is removed from the cartridge holder 100 will be referred to as "removal direction 8". The insertion direction 7 and the removal direction 8 are parallel to a horizontal direction and opposite to each other. Further, the insertion direction 7 and the removal direction 8 will be collectively referred to as "insertion-removal direction 9", and a direction orthogonal to the insertion-removal direction 9 and parallel to the horizontal direction will be referred to as "width direction".

Figure 2:
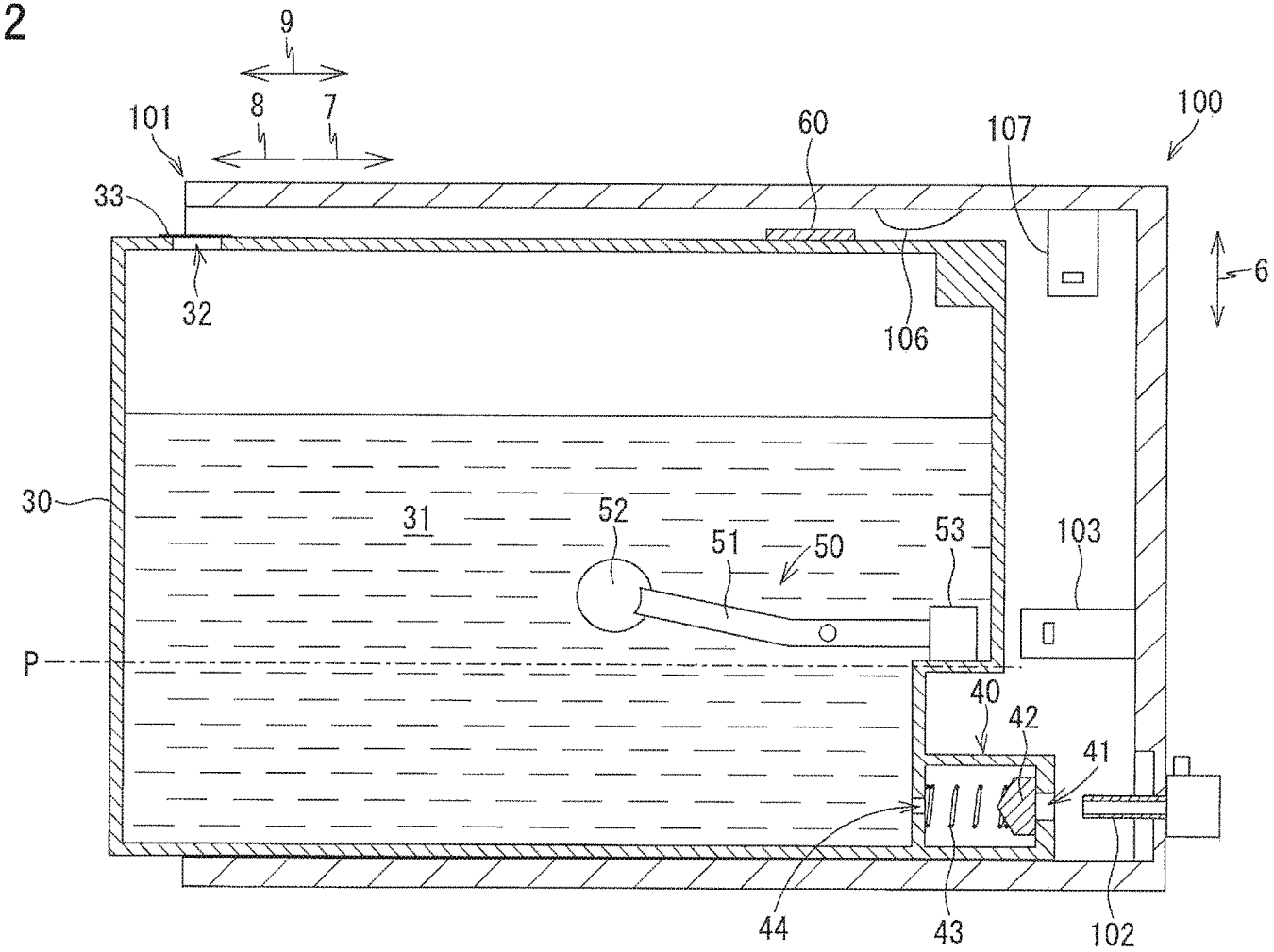
FIG. 2 is an elevational view in vertical cross section showing a state before a cartridge is mounted on the cartridge holder.

As shown in FIG. 2, the cartridge holder 100 includes a needle 102, a remaining-amount sensor 103, a contact 106, and a mount sensor 107. The cartridge holder 100 is configured to receive four cartridges 30 respectively storing black ink, cyan ink, magenta ink, and yellow ink. Each ink is colored by mixing a pigment of a particular color with a liquid. Four needles 102, four remaining-amount sensors 103, four contacts 106, and four mount sensors 107 are provided so as to correspond to the four cartridges 30. It is noted that the number of the cartridges 30 mountable on the cartridge holder 100 is not limited to four. One cartridge or five or more cartridges may be mountable.

Needle 102

The needle 102 protrudes from the end wall of the cartridge holder 100 in the removal direction 8. The needle 102 is a pipe in which a liquid passage is formed. The needle 102 is formed of a resin. One end (distal end) of the needle 102 exposed to the inner space of the cartridge holder 100 is open, and the tube 20 is connected to the other end (basal end) of the needle 102. The needle 102 is configured to allow fluid communication between a liquid chamber 31 (which will be explained) of the cartridge 30 mounted on the cartridge holder 100 and the tube 20. The distal end of the needle 102 is one example of "first end" of a liquid passage. Inner spaces of the needle 102 and the tube 20 are one example of "liquid passage".

Remaining-Amount Sensor 103

The remaining-amount sensor 103 is positioned at a height level higher than the needle 102 in an up-down direction 6. The remaining-amount sensor 103 includes a light emitting portion and a light receiving portion opposed to each other in the width direction. The cartridge 30 mounted on the cartridge holder 100 is disposed between the light emitting portion and the light receiving portion of the remaining-amount sensor 103. In other words, the light emitting portion and the light receiving portion are opposed to each other with the cartridge 30 mounted on the cartridge holder 100 interposed therebetween.

The remaining-amount sensor 103 outputs signals in different signal levels based on whether a light emitted from the light emitting portion is received by the light receiving portion. For instance, the remaining-amount sensor 103 outputs a low-level signal to a controller 130 (FIG. 5) in the case where the intensity of the light received by the light receiving portion is less than threshold intensity. On the other hand, the remaining-amount sensor 103 outputs, to the controller 130, a high-level signal whose signal level is higher than the low-level signal in the case where the intensity of the light received by the light receiving portion is not less than the threshold intensity.

Contact 106

The contact 106 is provided on the top wall of the cartridge holder 100 so as to protrude downward therefrom toward the inner space of the cartridge holder 100. The contact 106 is located at a position at which the contact 106 is in contact with an electrode of an IC chip 60 (which will be explained) of the cartridge 30 in a state in which the cartridge 30 is mounted on the cartridge holder 100. The contact 106 has conductivity and elasticity and is elastically deformable upward. The contact 106 is electrically connected to the controller 130.

Mount Sensor 107

Figure 3:
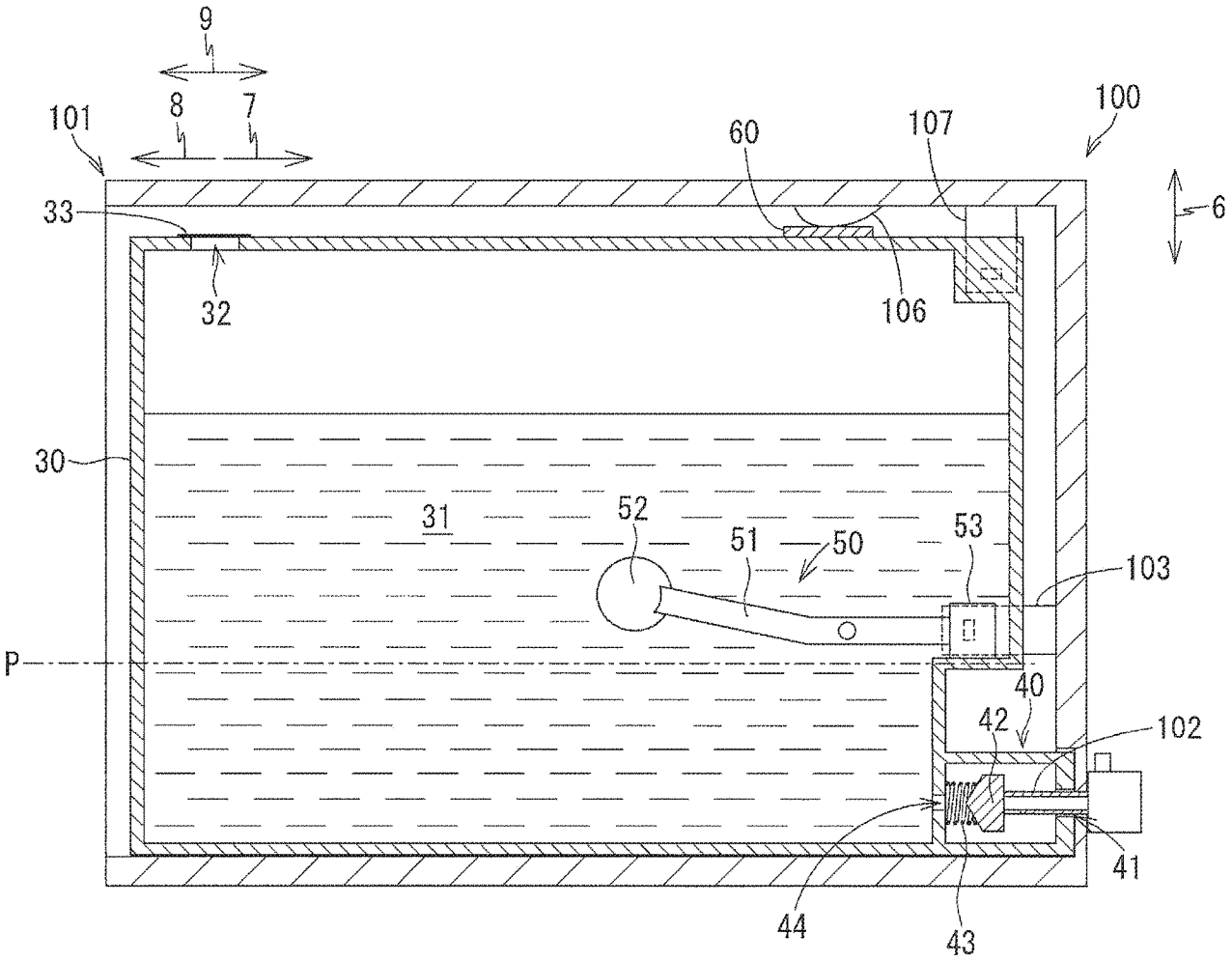
FIG. 3 is an elevational view in vertical cross section showing a state in which the cartridge is mounted on the cartridge holder and a detection element is positioned at a first position.
Figure 4:
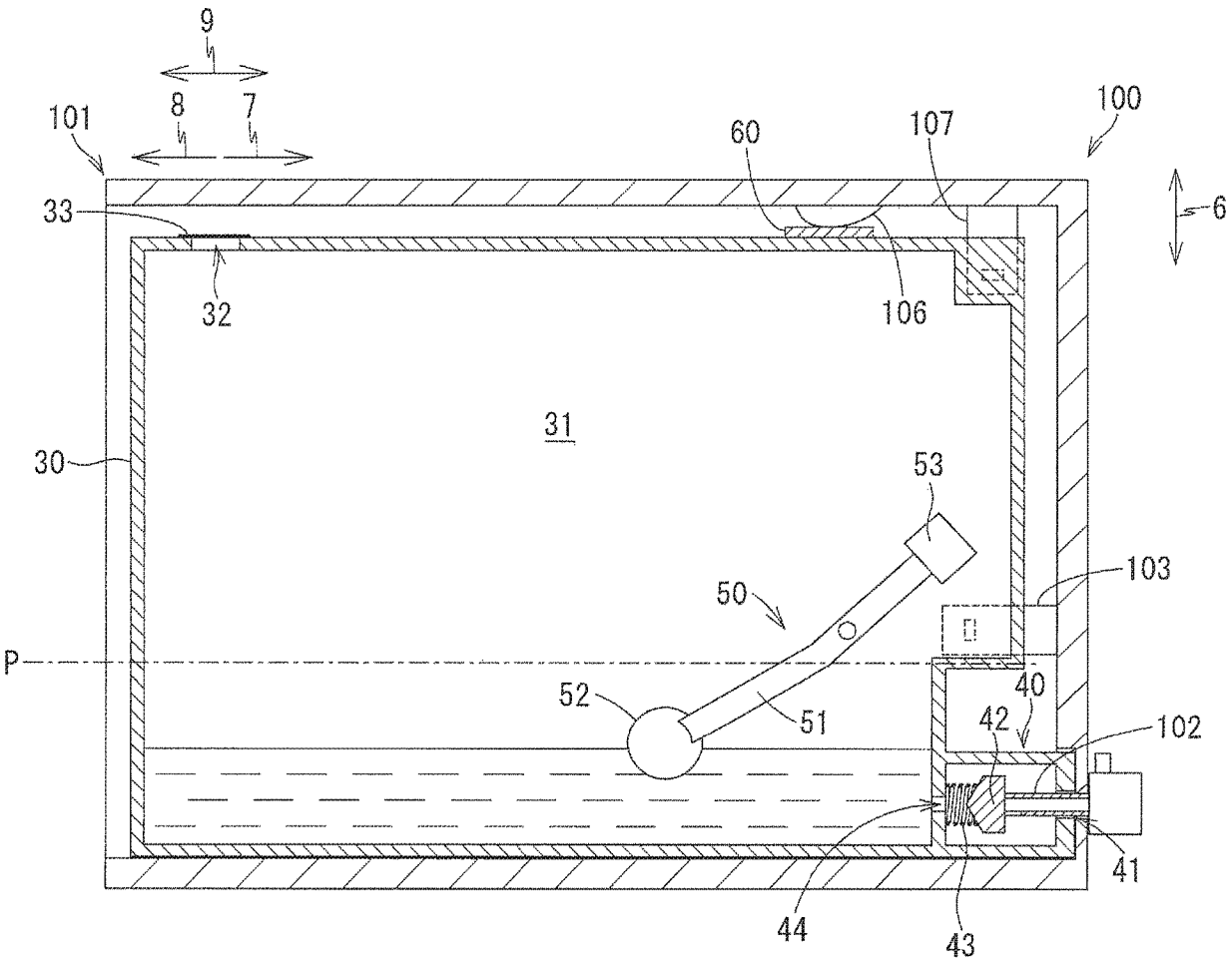
FIG. 4 is an elevational view in vertical cross section showing a state in which the cartridge is mounted on the cartridge holder and the detection element is positioned at a second position.

The mount sensor 107 is configured to output signals in different signal levels based on whether the cartridge 30 is mounted on the cartridge holder 100. Specifically, the mount sensor 107 outputs a low-level signal to the controller 130 in the case where the cartridge 30 is mounted on the cartridge holder 100, as shown in FIGS. 3 and 4. On the other hand, the mount sensor 107 outputs a high-level signal to the controller 130 in the case where the cartridge 30 is not mounted on the cartridge holder 100, as shown in FIG. 2.

Cartridge 30

As shown in FIG. 2, the cartridge 30 is a container having the liquid chamber 31 in which ink, as one example of a liquid, can be stored. The liquid chamber 31 is defined by resin walls, for instance. For instance, the cartridge 30 has a thin flat shape in which dimensions in the up-down direction 6 and the insertion-removal direction 9 are larger than a dimension in the width direction. Outer contours of the respective cartridges 30 in which mutually different colors of inks are stored may be the same or may be mutually different.

As shown in FIGS. 3 and 4, in the state in which the cartridge 30 is mounted on the cartridge holder 100, a wall of the cartridge 30 facing the remaining-amount sensor 103 allows the light emitted from the light emitting portion of the remaining-amount sensor 103 to pass therethrough. Further, in the state in which the cartridge 30 is mounted on the cartridge holder 100, a wall of the cartridge 30 facing the mount sensor 107 blocks the light emitted from the light emitting portion. The cartridge 30 includes an air communication opening 32, a supply pipe 40, a sensor arm 50, and the IC chip 60.

The air communication opening 32 allows fluid communication between the liquid chamber 31 and the exterior of the cartridge 30. The air communication opening 32 is formed at a height level higher than the supply pipe 40. The air communication opening 32 is sealed by a semipermeable membrane 33 that inhibits the ink from passing therethrough and allows the air to pass therethrough. Alternatively, the cartridge 30 may include a valve configured to open the air communication opening 32 when the cartridge 30 is mounted on the cartridge holder 100. This valve may be configured to close the air communication opening 32 when the cartridge 30 is removed from the cartridge holder 100.

The supply pipe 40 has a generally cylindrical outer contour and protrudes from a lower portion of the cartridge 30 in the insertion direction 7. An opening 41 is formed at a distal end of the supply pipe 40. An inner space of the supply pipe 40 fluidically communicates with the liquid chamber 31 through an opening 44. That is, the ink stored in the liquid chamber 31 flows out of the cartridge 30 via the inner space and the opening 41 of the supply pipe 40. A valve 42 and a coil spring 43 are disposed in the inner space of the supply pipe 40.

The valve 42 is configured to be movable in the inner space of the supply pipe 40 in the insertion-removal direction 9 between: a closed position (FIG. 2) at which the valve 42 closes the opening 41; and an open position (FIGS. 3 and 4) at which the valve 42 opens the opening 41. The coil spring 43 biases, in the insertion direction 7, the valve 42 toward the closed position. That is, when the valve 42 is positioned at the open position, the ink in the liquid chamber 31 flows out of the cartridge 30 through the opening 41. On the other hand, when the valve 42 is positioned at the closed position, the ink in the liquid chamber 31 does not flow out of the cartridge 30.

In the course of mounting the cartridge 30 on the cartridge holder 100, the needle 102 enters the inner space of the supply pipe 40 through the opening 41. The needle 102 entered the inner space of the supply pipe 40 moves the valve 42 from the closed position to the open position against the biasing force of the coil spring 43. Thus, the liquid chamber 31 of the cartridge 30 and the head 21 are brought into fluid communication with each other via the supply pipe 40, the needle 102, and the tube 20.

Sensor Arm 50

The sensor arm 50 is disposed in the liquid chamber 31. The sensor arm 50 includes an arm 51, a float 52, and a detection element 53. The arm 51 is pivotably supported in the liquid chamber 31 on a plane including the up-down direction 6 and the insertion-removal direction 9. The float 52 is formed of a material having a specific gravity smaller than that of the ink stored in the liquid chamber 31. The float 52 is provided at one end of the arm 51. The detection element 53 is formed of a material or has a color that blocks the light emitted from the light emitting portion of the remaining-amount sensor 103. The detection element 53 is provided at the other end of the arm 51.

The sensor arm 50 pivots in the liquid chamber 31 so as to take a posture in which buoyancy and gravity are balanced. That is, the sensor arm 50 pivots in accordance with a change in the amount of the ink stored in the liquid chamber 31. Specifically, when the liquid surface (the liquid level) of the ink in the liquid chamber 31 is not less than a detection position P, the sensor arm 50 takes a posture in which the detection element 53 is positioned at a first position, as shown in FIGS. 2 and 3. On the other hand, when the liquid surface (the liquid level) of the ink in the liquid chamber 31 is less than the detection position P, the sensor arm 50 takes a posture in which the detection element 53 is positioned at a second position different from the first position, as shown in FIG. 4.

The first position is a position at which the detection element 53 overlaps an optical path between the light emitting portion and the light receiving portion of the remaining-amount sensor 103 when the cartridge 30 is mounted on the cartridge holder 100. The second position is a position at which the detection element 53 deviates from the optical path between the light emitting portion and the light receiving portion of the remaining-amount sensor 103 when the cartridge 30 is mounted on the cartridge holder 100. The detection position P is a position of the liquid surface of the ink at a time when a predetermined amount (e.g., 50) of the ink is consumed from the amount of the ink (e.g., 100) stored in the liquid chamber 31 of the cartridge 30 in a brand-new state.

In other words, the remaining-amount sensor 103 outputs a low-level signal to the controller 130 when the detection element 53 of the cartridge 30 mounted on the cartridge holder 100 is positioned at the first position. That is, the remaining-amount sensor 103 outputs the low-level signal to the controller 130 when the liquid surface (the liquid level) of the ink in the cartridge 30 mounted on the cartridge holder 100 is not less than the detection position P. On the other hand, the remaining-amount sensor 103 outputs a high-level signal to the controller 130 when the detection element 53 of the cartridge 30 mounted on the cartridge holder 100 is positioned at the second position. That is, the remaining-amount sensor 103 outputs the high-level signal to the controller 130 when the liquid surface (the liquid level) of the ink in the cartridge 30 of the cartridge holder 100 is less than the detection position P.

The structures of the sensor arm 50 and the remaining-amount sensor 103 are optional. For instance, the controller 130 may obtain the remaining amount of the ink in the liquid chamber 31 of the cartridge 30 by subtracting an amount of the ink discharged from the head 21, from an initial amount V0 of the ink in the liquid chamber 31 and may store the obtained remaining amount in an EEPROM 134. The controller 130 may determine that the amount of the ink remaining in the liquid chamber 31 is small when an ink amount V stored in the EEPROM 134 reaches a threshold.

IC Chip 60

The IC chip 60 is disposed on an upper surface of the cartridge 30 in front of the air communication opening 32. On the IC chip 60, an electrode and a memory (not shown) are mounted. The electrode is electrically conductable with the contact 106. In the state in which the cartridge 30 is mounted on the cartridge holder 100, the IC chip 60 is electrically conductive with the contact 106. The controller 130 is capable of reading out information from and writing information in the memory of the IC chip 60 via the contact 106.

The memory of the IC chip 60 is one example of "cartridge memory" in which are stored an amount of the ink stored in the liquid chamber 31 (ink amount V), a cross-sectional area S of the liquid chamber 31, and a viscosity ρ of each region. The viscosity ρ indicates a viscosity of the ink stored in the cartridge 30. In a storage area of the memory of the IC chip 60, there are stored viscosities ρ of the ink in respective regions provided by dividing the liquid chamber 31 into a plurality of regions in the up-down direction 6, in a state in which an initially filled amount of the ink, namely, ink amount V0, is stored in the liquid chamber 31 of the cartridge 30.

Controller 130

Figure 5:
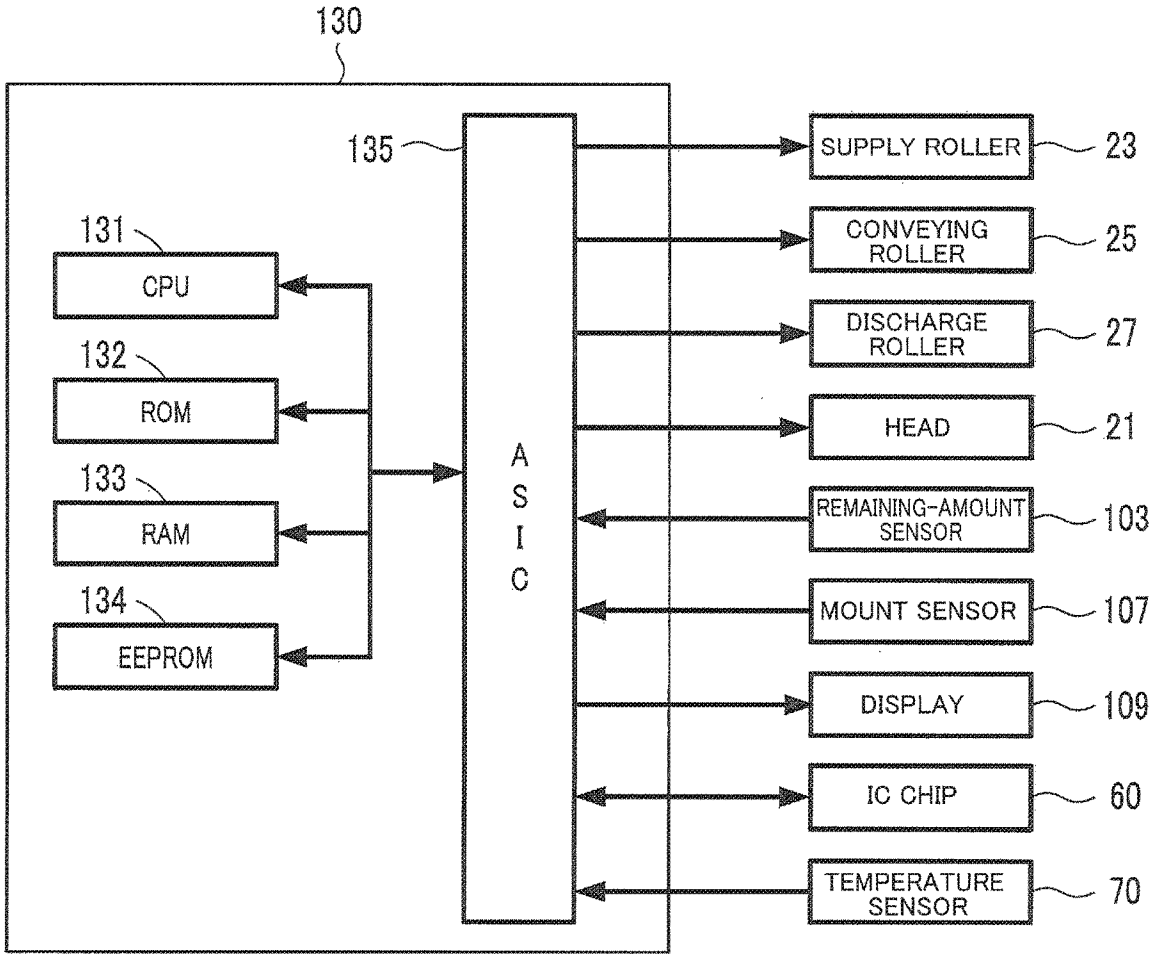
FIG. 5 is a block diagram of the printer.

The printer 10 includes the controller 130. As shown in FIG. 5, the controller 130 includes a CPU 131, a ROM 132, a RAM 133, an EEPROM 134 (as one example of "memory"), and an ASIC 135. The ROM 132 stores programs to be used by the CPU 131 for controlling various operations. The RAM 133 is used as a working area for data processing or as a storage area for temporarily storing data, signals, and the like to be used by the CPU 131 to execute the programs. The EEPROM 134 stores settings, flags, and the like to be retained even after the printer 10 is turned off.

The ASIC 135 is for causing the supply roller 23, the conveying rollers 25, the discharge rollers 27, and the head 21 to operate. The controller 130 drives a motor (not shown) via the ASIC 135, whereby the supply roller 23, the conveying rollers 25, and the discharge rollers 27 are rotated. Further, the controller 130 outputs a drive voltage to the piezoelectric elements (not shown) via the ASIC 135, whereby the ink is ejected from the nozzles 29 of the head 21. The ASIC 135 is capable of outputting the drive voltage at different levels.

To the ASIC 135, the IC chip 60, the temperature sensor 70, the remaining-amount sensor 103, the mount sensor 107, and a display 109 are connected. In other words, to the controller 130, the IC chip 60, the temperature sensor 70, the remaining-amount sensor 103, the mount sensor 107, and the display 109 are connected. Further, the controller 130 causes the display 109 to display information via the ASIC 135.

The EEPROM 134 stores various sorts of information in association with each of the plurality of cartridges 30 mounted on the cartridge holder 100, namely, in association with the color of each of the inks stored in the respective cartridges 30. Various sorts of information include a threshold Th1 (as one example of "first threshold") and a threshold Th2 (as one example of "second threshold"), a drive voltage E1 (as one example of "first value") and a drive voltage E2 (as one example of "second value"), a viscosity reference table, temperature correction coefficients, and mixture ratio tables.

The threshold Th1 is a value for selectively applying one of the drive voltage E1 and the drive voltage E2 of the head 21, with respect to a viscosity ρ of a lowermost one of the plurality of regions in the liquid chamber 31. The threshold Th2 is a value for determining whether purging is to be performed, with respect to the viscosity ρ of the lowermost one of the plurality of regions in the liquid chamber 31. The threshold Th2 is larger than the threshold Th1.

As shown in FIG. 8A, the viscosity reference table indicates a value of the viscosity ρ that increases or decreases per unit time for each of five regions. The five regions are provided by dividing, into five lengthwise regions, a height in the up-down direction 6 from the bottom of the liquid chamber 31 to the liquid surface. In the case where the height in the up-down direction 6 from the bottom of the liquid chamber 31 to the liquid surface is represented as 100%, the five regions are a region corresponding to a length of 0-5% of the height in the up-down direction 6, a region corresponding to a length of 5-20% of the height in the up-down direction 6, a region corresponding to a length of 20-80% of the height in the up-down direction 6, a region corresponding to a length of 80-95% of the height in the up-down direction 6, and a region corresponding to a length of 95-100% of the height in the up-down direction 6. In these five regions, the length in the up-down direction 6 of the 0-5% region located at a lowermost portion of the liquid chamber 31 and the length in the up-down direction 6 of the 95-100% region located at an uppermost portion of the liquid chamber 31 are smaller than the length in the up-down direction 6 of each of the other three regions. The values of the viscosity ρ that increases or decreases per unit time are +3, +1, ±0, −0.5, −1, which are assigned to the respective five regions in this order from the bottom of the liquid chamber 31. The unit time is thirty days, for instance. The five regions may be considered as regions provided by dividing a region occupied by the ink in the liquid chamber 31 into five sub-regions in the up-down direction 6. Further, the five regions may be considered as follows. The lowermost region is a region (0-5%) ranging from a lower end of the region in the fluid chamber 31 occupied by the ink to a height level corresponding to 5%, for instance. The second region from the bottom is a region (5%-20%) ranging from the height level corresponding to 5% to a height level corresponding to 20%, for instance. The third region from the bottom is a region (20-80%) ranging from the height level corresponding to 20% to a height level corresponding to 80%, for instance. The fourth region from the bottom is a region (80%-95%) ranging from the height level corresponding to 80% to a height level corresponding to 95%, for instance. The uppermost region is a region ranging from height level corresponding to 95% to a height level corresponding to 100%, for instance. Further, an amount of the ink in the 0-5% region (i.e., a lowermost one of the five regions) and an amount of the ink in the 95-100% region (i.e., an uppermost one of the five regions) are smaller than an amount of the ink in each of the other three regions.

The temperature correction coefficients are assigned such that a coefficient "1" as a reference is assigned to a temperature 25° C., a coefficient "1.3" is assigned to a temperature 33° C., and a coefficient "1.6" is assigned to a temperature 40° C.

As shown in FIG. 8B, in the mixture ratio tables, two ink ejection amounts per unit time, i.e., PV100 and PV500, are set, and a ratio occupied by each region after a lapse of the unit time is indicated in "%" for each ink ejection amount. For instance, after the ink has been used in PV100 for thirty days, the ink in the lowermost 0-5% region after re-division of the liquid chamber 31 is composed of the ink having been included in the 5-20% region immediately before the re-division and the ink having been included in the 20-80% region immediately before the re-division. Specifically, 98% of the ink in the lowermost 0-5% region after the re-division is the ink having been included in the 5-20% region immediately before the re-division and 2% of the ink in the lowermost 0-5% region after the re-division is the ink having been included in the 20-80% region immediately before the re-division. In other words, when the ink is discharged from the head 21, at least a part of the ink having existed in the 5-20% region (as one example of "second region") before the discharge constitutes at least a part (98%) of the ink in the 0-5% region (as one example of "first region") after the discharge. Further, at least a part of the ink having existed in the 20-80% region (as one example of "second region") before the discharge constitutes at least a part (2%) of the ink in the 0-5% region (as one example of "first region") after the discharge.

Operation of Printer 10

Figure 6:
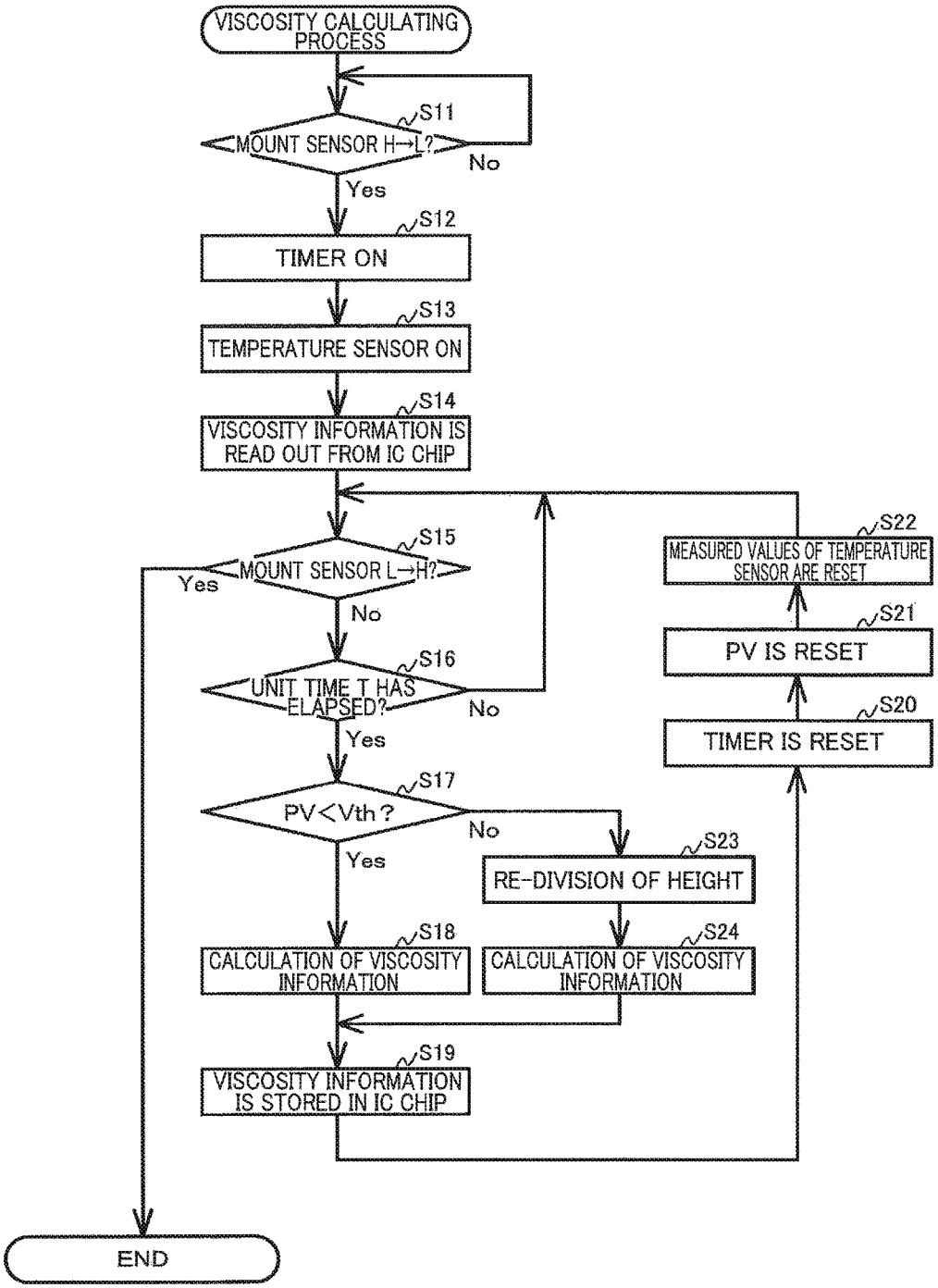
FIG. 6 is a flowchart showing a viscosity calculating process.
Figure 7:
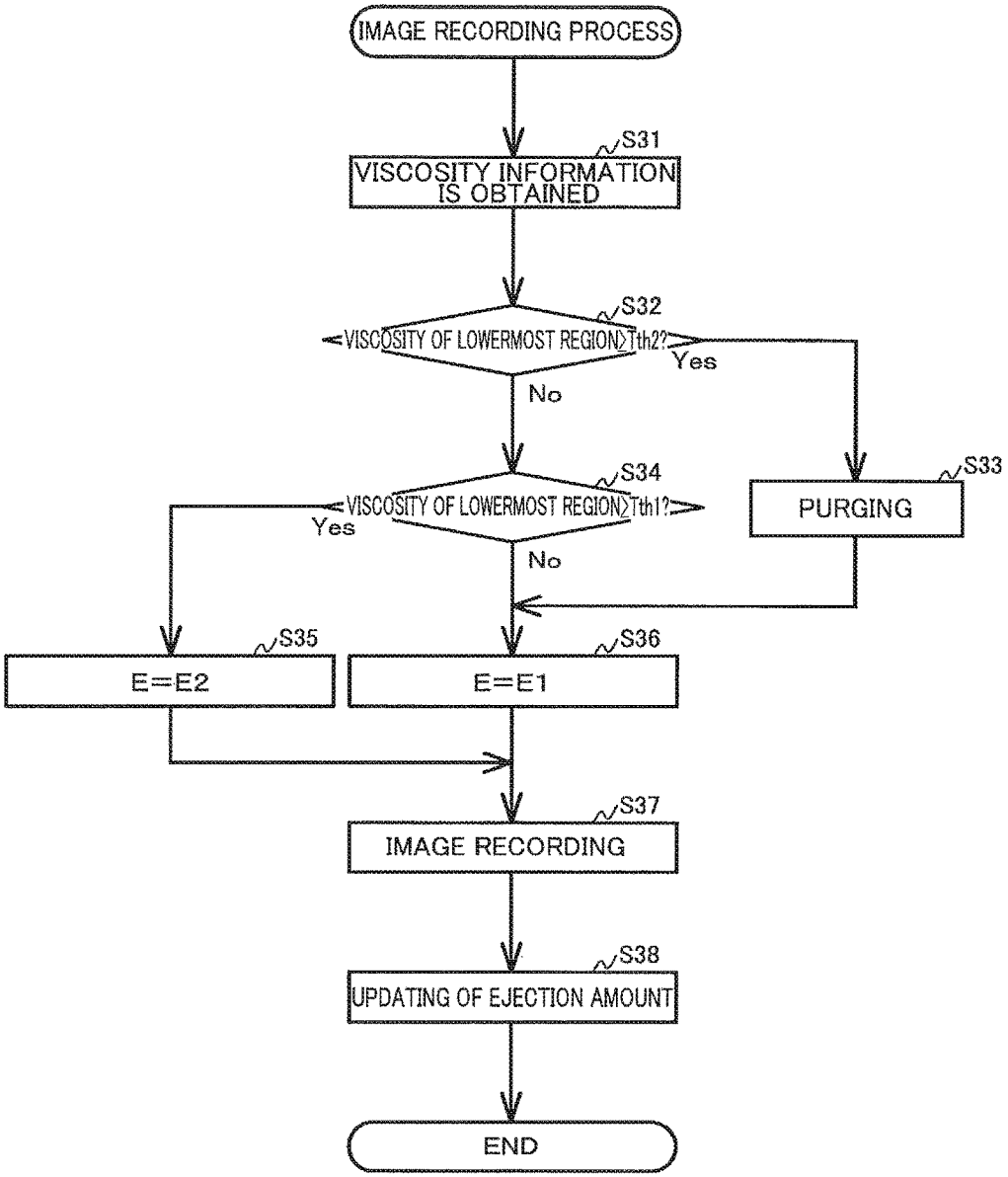
FIG. 7 is a flowchart showing an image recording process.

Referring to FIGS. 6 and 7, there will be explained an operation of the printer 10 according to the present embodiment. Processes shown in FIGS. 6 and 7 are executed by the CPU 131 of the controller 130. The following processes may be executed by the CPU 131 by reading the programs stored in the ROM 132 or may be executed by hardware circuits installed on the controller 130. The order of execution of the following processes may be changed without departing from the scope of the present disclosure.

Viscosity Calculating Process

When the printer 10 is turned on, the controller 130 executes a viscosity calculating process. The controller 130 determines whether the output of the mount sensor 107 is changed from the high-level signal to the low-level signal (S11). The output of the mount sensor 107 is changed from the high-level signal to the low-level signal when the cartridge 30 is mounted on the cartridge holder 100 after the printer 10 is turned on.

When the controller 130 determines that the output of the mount sensor 107 is changed from the high-level signal to the low-level signal (S11: Yes), the controller 130 causes a timer to start operating (S12). The timer is provided by a clock incorporated in the controller 130, for instance. The controller 130 switches the temperature sensor 70 into an on state (S13) and stores, in the EEPROM 134, the temperature values measured by the temperature sensor 70 at predetermined time intervals. The controller 130 reads out the values of the viscosity ρ for the respective regions stored in the memory of the IC chip 60 of the cartridge 30 (S14) and stores the read viscosity values in the EEPROM 134. There are stored, in the memory of the IC chip 60, the viscosity ρ of the ink in each of the five regions in a state in which the cartridge 30 stores the ink in the initial ink amount V0. Each of the viscosities ρ of the ink in the respective regions stored in the memory of the IC chip 60 is an initial value ρ0.

The controller 130 subsequently determines whether the output of the mount sensor 107 is changed from the low-level signal to the high-level signal (S15). When the controller 130 determines that the output of the mount sensor 107 is changed from the low-level signal to the high-level signal (S15: Yes), the controller 130 ends the viscosity calculating process.

On the other hand, when the controller 130 determines that the output of the mount sensor 107 is not changed from the low-level signal to the high-level signal (S15: No), the controller 130 determines based on the measured value of the timer whether the unit time T has elapsed (S16). The unit time T is thirty days, for instance. When the controller 130 determines that the unit time T has not yet elapsed (S16: No), the control flow goes back to S15.

When the controller 130 determines that the unit time T has elapsed (S16: Yes), the controller 130 determines whether a cumulative ink amount ejected from the head 21 before the lapse of the unit time T is less than a threshold Vth (S17). The threshold Vth is a value for determining whether the head 21 has ejected the ink by an amount that approximates to a smaller one of the ejection amounts PV100, PV500 of the mixture ratio tables, namely, the ejection amount PV100. For instance, "PV50" is set as the threshold Vth.

When the controller 130 determines that the ink amount ejected from the head 21 before the lapse of the unit time T is less than the threshold Vth (S17: Yes), the controller 130 calculates the viscosities of the respective regions (S18). Specifically, referring to the viscosity reference table, the controller 130 increments or decrements the viscosity of each of the five regions with respect to the initial viscosity ρ0 and stores the incremented or decremented viscosity ρ of each region in the EEPROM 134. For instance, the viscosity of the 0-5% region becomes equal to ρ0+3 (ρ=ρ0+3). Further, the controller 130 calculates an average value of the measured values of the temperature sensor 70 stored in the EEPROM 134, reads out, from the EEPROM 134, one of the coefficients corresponding to the average value of the temperature, and multiplies the incremented or decremented viscosity ρ by the selected coefficient. For instance, in the case where the average value of the temperature is 25° C., the controller 130 multiplies the viscosity ρ by the coefficient "1" and stores, in the EEPROM 134, the viscosity ρ multiplied by the coefficient "1". The controller 130 writes, in the memory of the IC chip 60 of the cartridge 30, the viscosity ρ of each region stored in the EEPROM 134 (S19).

The controller 130 subsequently resets the timer being operated and causes the timer to be operated again (S20). The controller 130 then resets, to "0", the cumulative ink amount ejected by the head 21 that is stored in the EEPROM 134 (S21) and deletes the measured values of the temperature sensor 70 stored in the EEPROM 134 (S22). The control flow thereafter goes back to S15.

When the controller 130 determines that the ink amount ejected from the head 21 before the lapse of the unit time T is not less than the threshold Vth (S17: Yes), the controller calculates the height of the liquid surface of the ink stored in the liquid chamber 31 of the cartridge 30 and re-divides the height h from the bottom of the liquid chamber 31 to the liquid surface, into the five regions (S23). The ink in the liquid chamber 31 is decreased from the initial ink amount V0 by an amount corresponding to the amount ejected from the head 21. The controller 130 calculates, for the remaining ink amount, a current height h from the bottom of the liquid chamber 31 to the liquid surface based on the cross-sectional area of the liquid chamber 31, and re-divides the height h into the five regions.

The controller 130 subsequently calculates the viscosity ρ for each of the re-divided five regions (S24). The controller 130 determines which one of the two mixture ratio tables (for PV100 and for PV500) is to be applied based on the ink amount ejected from the head 21 before the lapse of the unit time T. For instance, this determination is made such that the mixture ratio table for PV100 is applied in the case where the ink amount ejected from the head 21 before the lapse of the unit time T is less than PV300 and such that the mixture ratio table for PV500 is applied in the case where the ink amount ejected from the head 21 before the lapse of the unit time T is not less than PV300.

For instance, after the ink has been used in PV100 for thirty days, the ink in the lowermost 0-5% region after the re-division of the liquid chamber 31 is composed of the ink having been included in the 5-20% region immediately before the re-division and the ink having been included in the 20-80% region immediately before the re-division. Specifically, 98% of the ink in the lowermost 0-5% region after the re-division is the ink having been included in the 5-20% region immediately before the re-division and 2% of the ink in the lowermost 0-5% region after the re-division is the ink having been included in the 20-80% region immediately before the re-division. Accordingly, 98% of the ink in the lowermost 0-5% region after the re-division is constituted by the ink whose viscosity ρ is equal to ρ0+1 (ρ=ρ0+1), and 2% of the ink in in the lowermost 0-5% region after the re-division is constituted by the ink whose viscosity ρ is equal to ρ0±0 (ρ=ρ0±0). Thus, the viscosity ρ in the 0-5% region after the re-division is calculated to be ρ0+0.98 (ρ=ρ0+0.98). In this way, the controller 130 calculates the viscosity ρ in each of the re-divided regions and stores the calculated viscosities in the EEPROM 134 and in the memory of the IC chip 60. Thereafter, the controller 130 executes the processes of S19-S22, and the control flow then goes back to S15.

Image Recording Process

The controller 130 executes an image recording process shown in FIG. 7 when the printer 10 accepts a recording instruction. The printer 10 may receive the recording instruction from any source. For instance, the recording instruction may be received from a user through an operation panel (not shown) or may be received from an external device through a communication interface (not shown).

The controller 130 initially obtains viscosity information for each region stored in the EEPROM 134 (S31). The controller then determines whether, among the obtained viscosity information, the viscosity ρ of the lowermost 0-5% region is not less than the threshold Th2 (S32).

When the controller 130 determines that the viscosity ρ of the 0-5% region is not less than the threshold Th2 (32: Yes), purging is performed (S33). The purging may be an operation to discharge the ink from the head 21 by covering the head 21 with a cap and reducing the pressure in the cap or may be an operation to discharge the ink from the head 21 by applying a pressure to the head 21 or to the liquid chamber 31 of the cartridge 30. In the case where the viscosity ρ of the 0-5% region is not less than the threshold Th2, the controller 130 determines the ink in the 0-5% region as the ink difficult to be ejected from the head 21, and the ink is discharged from the head 21. The amount of the ink discharged by the purging may be equal to an amount that enables an entire amount of the ink in the 0-5% region to be discharged from the liquid chamber 31 of the cartridge 30 or may be equal to an amount that enables a part of the ink in the 0-5% region to be discharged.

On the other hand, when the controller 130 determines that the viscosity ρ of the 0-5% region is less than the threshold Th2 (32: No), the controller 130 determines whether the viscosity ρ of the region 0-5% is not less than the threshold Th1 (S34). When the controller 130 determines that the viscosity ρ of the 0-5% region is not less than the threshold Th1 (34: Yes), the controller 130 sets a voltage E=E2 as a drive voltage applied to the head 21 (S35). On the other hand, when the controller 130 determines that the viscosity ρ of the 0-5% region is less than the threshold Th1 (34: No), the controller 130 sets a voltage E=E1 as the drive voltage applied to the head 21 (S36). The voltage E2 is higher than the voltage E1. In the case where the viscosity ρ of the 0-5% region is not less than the threshold Th1, the controller 130 determines the ink in the 0-5% region as the ink for which an increase in the drive voltage for ejecting the ink from the head 21 is necessary, and the voltage E2 is set as the drive voltage.

The controller 130 subsequently performs image recording by the set drive voltage (S37). Specifically, the controller 130 causes the supply roller 23 and the conveying rollers 25 to convey the sheet on the sheet-supply tray 15, causes the head 21 to eject the ink based on the set drive voltage, and causes the discharge rollers 27 to convey the sheet. Thus, an image is recorded on the sheet, and the sheet on which the image is recorded is conveyed toward the sheet-discharge tray 16.

Subsequently, the controller 130 adds the ink amount ejected from the head 21 in the image recording to the ink amount stored in the EEPROM 134. Further, the controller 130 stores the ink amount in the memory of the IC chip 60 (S38). Thus, the image recording process is ended.

Advantageous Effects

According to the embodiment illustrated above, the controller 130 calculates the height h in the up-down direction 6 from the bottom of the liquid chamber 31 to the liquid surface, based on the ink amount V and the cross-sectional area S of the liquid chamber 31, divides the calculated height h into the five regions in the up-down direction 6, calculates the changed viscosity ρ for each region in accordance with the time elapsed after the time point of mounting of the cartridge 30 onto the cartridge holder 100, and stores the calculated viscosities in the EEPROM 134. With this configuration, the controller 130 can calculate the changed viscosities ρ for the plurality of regions, in accordance with the height of the liquid surface of the ink in the liquid chamber 31 of the cartridge 30. Further, the controller 130 can change the drive voltage by which the head 21 discharges the ink or can perform the purging, in accordance with the changed viscosity ρ of the ink in each region.

Further, the controller 130 subtracts the ink amount discharged from the head 21 from the ink amount V stored in the EEPROM 134 so as to update the ink amount V and calculates the height h in the up-down direction 6 from the bottom of the liquid chamber 31 to the liquid surface, based on the updated ink amount V and the cross-sectional area S. The controller 130 divides the calculated height h into the five regions in the up-down direction and calculates the changed viscosities ρ for the respective updated five regions by assigning the viscosities ρ of the respective pre-updated five regions stored in the EEPROM 134 to the updated five regions, so as to calculate the changed viscosities ρ for the respective updated five regions. With this configuration, in the case where the ink is discharged from the head 21 and the height h of the liquid surface of the ink in the liquid chamber 31 of the cartridge 30 is accordingly changed, the controller 130 again divides the changed height h into the plurality of regions and calculates the changed viscosity for each region.

According to the embodiment illustrated above, the length in the up-down direction 6 of the 0-5% region located at the lowermost portion of the liquid chamber 31 and the length in the up-down direction 6 of the 95-100% region located at the uppermost portion of the liquid chamber 31 are smaller than the lengths of the other three regions. With this configuration, it is possible to accurately estimate an increase or a decrease in the viscosity ρ of the ink in each of the regions respectively located at the lowermost portion and at the uppermost portion of the liquid chamber 31 at which the viscosity ρ is likely to increase or decrease.

The printer 10 includes the temperature sensor 70, and the controller 130 selects one of the correction coefficients in accordance with the output of the temperature sensor 70 and multiplies the changed viscosity ρ by the selected correction coefficient. With this configuration, the controller 130 can calculate the changed viscosity ρ in accordance with a change (increase or decrease) in the viscosity ρ due to the environmental temperature in which the printer 10 is placed.

The controller 130 changes the drive voltage of the head 21 to the voltage E2 higher than the voltage E1 when the viscosity ρ of the 0-5% region located at the lowermost portion of the liquid chamber 31 of the cartridge 30 is not less than the threshold Th1. This configuration obviates non-discharge of the ink from the head 21 due to the increased viscosity.

The controller 130 performs the purging when the changed viscosity ρ of the 0-5% region located at the lowermost portion of the liquid chamber 31 of the cartridge 30 is not less than the threshold Th2. This configuration obviates image recording by the ink difficult to be ejected from the head 21.

The controller 130 stores the viscosities ρ of the respective five regions in the memory of the IC chip 60 through the contact 106. With this configuration, in the case where the cartridge 30 which has been once used is again mounted on the cartridge holder 100, the controller 130 can read out information relating to the changed viscosities ρ of the respective regions so far from the memory of the IC chip 60 of the again mounted cartridge 30.

The controller 130 reads out the viscosities ρ of the respective five regions stored in the memory of the IC chip 60 and stores, in the EEPROM 134, the viscosities ρ read out from the memory of the IC chip 60. With this configuration, in the case where the cartridge 30 which has been once used is again mounted on the cartridge holder 100, the controller 130 takes over information relating to the changed viscosities ρ of the respective regions so far and calculates an increase or decrease in the viscosities ρ thereafter.

Modifications

In the embodiment illustrated above, the controller 130 subtracts the ink amount discharged from the head 21 from the ink amount V stored in the EEPROM 134 so as to update the ink amount V and calculates the viscosity ρ in each of the re-divided five regions based on the mixture ratio table. The present disclosure is not limited to this configuration. The controller 130 may be configured to calculate the viscosity ρ in each of the re-divided five regions according to another method, in place of the method described above. For instance, the controller 130 may be configured to store, in the EEPROM 134, a length in the up-down direction 6 of each of the five regions and to determine a ratio occupied by each of the five regions before the re-division with respect to each of the re-divided five regions, based on the length in the up-down direction of each of the re-divided five regions stored in EEPROM 134, so as to calculate the viscosity ρ in each of the re-divided five regions based on the determined ratios.

Specifically, assuming that one-half (½) the amount of the ink in the lowermost 0-5% region of the liquid chamber 31 flows out of the liquid chamber 31, in the lowermost one of the five regions after the re-division, a ratio of the ink included in the lowermost 0-5% region before the re-division is about 51.3%. The remainder, namely, 48.7%, is the ink included in the 5-20% region before the re-division. Accordingly, the viscosity ρ in the lowermost 0-5% region after the re-division is equal to ρ0+2.026 (ρ=ρ0+2.026).

In the illustrated embodiment, two mixture ratio tables, namely, the mixture ratio table for the ink ejection amount PV100 and the mixture ratio table for the ink ejection amount PV500, are stored in the EEPROM 134. The present disclosure is not limited to this configuration. For instance, a larger number of the mixture ratio tables may be stored in the EEPROM 134 in accordance with the number of the ink ejection amounts. Further, the mixture ratio for the ink ejection amounts other than PV100, PV500 may be obtained by calculation, based on the two mixture ratio tables.

In the illustrated embodiment, the length in the up-down direction 6 of the 0-5% region located at the lowermost portion of the liquid chamber 31 and the length in the up-down direction 6 of the 95-100% region located at the uppermost portion of the liquid chamber 31 are smaller than the lengths in the up-down direction 6 of the other three regions. The present disclosure is not limited to this configuration. Instead, only the length in the up-down direction 6 of the lowermost 0-5% region may be smaller than the lengths in the up-down direction 6 of the other regions, for instance.

Further, there may exist a region or regions having the same length as the length in the up-down direction 6 of the lowermost 0-5% region.

In the illustrated embodiment, the height h from the bottom of the liquid chamber 31 of the cartridge 30 to the liquid surface of the ink is divided into five regions. The number of divisions is not limited to 5, but may be smaller or larger than 5.

In the illustrated embodiment, the viscosity ρ after having increased or decreased from the initial viscosity ρ0 is stored in the EEPROM 134 and the memory of the IC chip 60. The present disclosure is not limited to this configuration. For instance, the controller 130 may be configured to store, in the EEPROM 134 and the memory of the IC chip 60, only an increased or decreased amount, in place of the viscosity ρ.

In the illustrated embodiment, the ink including the pigment is illustrated as one example of the liquid. The present disclosure is not limited to this configuration. The liquid may be a pre-treatment liquid ejected prior to ejection of the ink in image recording, for instance, as long as a change in the viscosity occurs with passage of time.

What is claimed is:

1. An image recording apparatus, comprising:

a holder on which a cartridge is to be mounted, the cartridge including a liquid chamber storing a liquid;

a head configured to discharge the liquid;

a liquid-passage defining portion defining a liquid passage, the liquid passage including a first end and a second end connected to the head, the first end configured to be connected to the liquid chamber of the cartridge when the cartridge is mounted on the holder; and a controller, wherein the controller is configured to:

divide a region in the liquid chamber of the cartridge occupied by the liquid into a plurality of regions in an up-down direction; and determine a viscosity of the liquid in each of the plurality of regions, based on a time elapsed from a timing of connection of the liquid chamber of the cartridge and the first end of the liquid passage, and wherein, when the liquid in the liquid chamber is discharged from the head, the controller updates the viscosity of the liquid in each of the plurality of regions, based on an amount of the liquid discharged from the head.

2. The image recording apparatus according to claim 1, further comprising a memory configured to store a cross-sectional area of the liquid chamber and an amount and the viscosity of the liquid in the liquid chamber, wherein the controller is configured to determine the viscosity of the liquid in each of the plurality of regions, based on the viscosity of the liquid stored in the memory and the time elapsed from the timing of connection of the liquid chamber of the cartridge and the first end of the liquid passage.

3. The image recording apparatus according to claim 2, wherein the controller is configured to store, in the memory, the determined viscosity of the liquid in each of the plurality of regions.

4. The image recording apparatus according to claim 3, wherein the controller is configured to:

update the amount of the liquid in the liquid chamber stored in the memory by subtracting, therefrom, an amount corresponding to the amount of the liquid discharged from the head;

determine a height in the up-down direction from a bottom of the liquid chamber to a surface of the liquid based on the updated amount of the liquid in the liquid chamber and the cross-sectional area;

re-divide the region in the liquid chamber occupied by the liquid into a plurality of regions in the up-down direction, based on the determined height; and determine a viscosity of the liquid in each of the plurality of re-divided regions based on:

the viscosity of the liquid in each of the plurality of regions stored in the memory prior to the re-division; and the time elapsed from the timing of connection of the cartridge and the liquid passage.

5. The image recording apparatus according to claim 4, wherein the controller is configured to:

store, in the memory, a length in the up-down direction of each of the plurality of re-divided regions;

determine a ratio occupied by each of the plurality of regions prior to the re-division with respect to each of the plurality of re-divided regions, based on the length in the up-down direction of each of the plurality of re-divided regions stored in the memory; and determine the viscosity of the liquid in each of the plurality of re-divided regions based on the determined ratios.

6. The image recording apparatus according to claim 1, wherein the controller is configured to determine a height in the up-down direction from a bottom of the liquid chamber to a surface of the liquid and divide the liquid in the liquid chamber into the plurality of regions in the up-down direction, based on the determined height.

7. The image recording apparatus according to claim 1, wherein the controller is configured to determine the viscosity of the liquid in each of the plurality of regions based on:

a change amount of the viscosity per unit time determined in advance for each of the plurality of regions; and the time elapsed from the timing of connection of the cartridge and the liquid passage.

8. The image recording apparatus according to claim 1, wherein the plurality of regions include a first region and a second region located above the first region, and wherein, when the liquid in the liquid chamber is discharged from the head, the controller determines a viscosity of the liquid in the first region after the discharge of the liquid by assuming that at least a part of the liquid having existed in the second region before the discharge of the liquid includes at least a part of the liquid in the first region after the discharge of the liquid.

9. The image recording apparatus according to claim 1, wherein an amount of the liquid in a lowermost one of the plurality of regions is smaller than an amount of the liquid in at least one of the plurality of regions other than the lowermost one of the plurality of regions.

10. The image recording apparatus according to claim 9, wherein the amount of the liquid in the lowermost one of the plurality of regions and an amount of the liquid in an uppermost one of the plurality of regions are smaller than amounts of the liquid in the plurality of regions other than both of the lowermost one of and the uppermost one of the plurality of regions.

11. The image recording apparatus according to claim 1, further comprising:

a temperature sensor configured to measure an environmental temperature; and a memory configured to store a plurality of correction coefficients respectively corresponding to a plurality of values of the temperature, wherein the controller is configured to determine the viscosity of the liquid in each of the plurality of regions based on one of the plurality of correction coefficients selected in accordance with an output of the temperature sensor.

12. The image recording apparatus according to claim 1, wherein, when a viscosity of the liquid in a lowermost one of the plurality of regions is less than a first threshold, the controller sets, to a first value, a discharge energy which is applied to the head to discharge the liquid from the head, and wherein, when the viscosity of the liquid in the lowermost one of the plurality of regions is not less than the first threshold, the controller sets the discharge energy to a second value larger than the first value.

13. The image recording apparatus according to claim 1, wherein, when a viscosity of the liquid in a lowermost one of the plurality of regions is less than a second threshold, the controller does not perform purging for forcibly discharging the liquid from the head, and wherein, when the viscosity of the liquid in the lowermost one of the plurality of regions is not less than the second threshold, the controller performs the purging.

14. The image recording apparatus according to claim 1, further comprising a contact, wherein the cartridge includes a cartridge memory electrically conductive with the contact in a state in which the cartridge is mounted on the holder, and wherein the controller is configured to store the determined viscosity of the liquid in each of the plurality of regions in the cartridge memory through the contact.

15. The image recording apparatus according to claim 14, further comprising a memory configured to store a cross-sectional area of the liquid chamber and an amount and the viscosity of the liquid stored in the liquid chamber, wherein the controller is configured to read out the viscosity of the liquid in each of the plurality of regions stored in the cartridge memory and store, in the memory, the viscosity read out from the cartridge memory.

16. An image recording apparatus, comprising:

a holder on which a cartridge is to be mounted, the cartridge including a liquid chamber storing a liquid;

a head configured to discharge the liquid;

a liquid-passage defining portion defining a liquid passage, the liquid passage including a first end and a second end connected to the head, the first end configured to be connected to the liquid chamber of the cartridge when the cartridge is mounted on the holder; and a controller, wherein the controller is configured to divide a region in the liquid chamber of the cartridge occupied by the liquid into a plurality of regions in an up-down direction and determine a viscosity of the liquid in each of the plurality of regions, based on a time elapsed from a timing of connection of the liquid chamber of the cartridge and the first end of the liquid passage.

17. The image recording apparatus according to claim 16, wherein the plurality of regions include a first region and a second region located above the first region, and wherein, when the liquid in the liquid chamber is discharged from the head, the controller determines a viscosity of the liquid in the first region after the discharge of the liquid by assuming that at least a part of the liquid having existed in the second region before the discharge of the liquid includes at least a part of the liquid in the first region after the discharge of the liquid.

18. The image recording apparatus according to claim 16, wherein an amount of the liquid in a lowermost one of the plurality of regions is smaller than an amount of the liquid in at least one of the plurality of regions other than the lowermost one of the plurality of regions.

19. The image recording apparatus according to claim 16, wherein, when a viscosity of the liquid in a lowermost one of the plurality of regions is less than a first threshold, the controller sets, to a first value, a discharge energy which is applied to the head to discharge the liquid from the head, and when the viscosity of the liquid in the lowermost one of the plurality of regions is not less than the first threshold, the controller sets the discharge energy to a second value larger than the first value, and, wherein, when the viscosity of the liquid in the lowermost one of the plurality of regions is less than a second threshold larger than the first threshold, the controller does not perform purging for forcibly discharging the liquid from the head, and when the viscosity of the liquid in the lowermost one of the plurality of regions is not less than the second threshold, the controller performs the purging.

20. A cartridge to be mounted on an image recording apparatus, the cartridge including a liquid chamber storing a liquid, wherein the image recording apparatus includes a holder on which the cartridge is to be mounted, a contact, and a controller, wherein the cartridge includes a cartridge memory electrically conductive with the contact connected to the controller, in a state in which the cartridge is mounted on the holder, and wherein the cartridge memory stores a viscosity of the liquid in each of a plurality of regions provided by dividing, in an up-down direction, a region in the liquid chamber occupied by the liquid.

* * * * *